United States Patent [19]

Cusenza

[11] Patent Number: 4,913,174

[45] Date of Patent: Apr. 3, 1990

[54] HAIR FASTENER

[75] Inventor: John M. Cusenza, Tarzana, Calif.

[73] Assignee: Cusenza Partnership, Woodland Hills, Calif.

[21] Appl. No.: 128,778

[22] Filed: Dec. 4, 1987

[51] Int. Cl.[4] ..... A45D 8/00

[52] U.S. Cl. ..... 132/278; 132/261; 132/273

[58] Field of Search ..... 132/46 R, 40, 46 A, 132/43 A, 43 R, 44, 212, 261, 262, 256, 273, 275, 276, 277, 278, 279

[56] References Cited

U.S. PATENT DOCUMENTS

| | | | |
|---|---|---|---|
| 1,767,681 | 6/1930 | Kapustka | 132/46 A |
| 2,465,745 | 3/1949 | Orr et al. | 132/256 |
| 2,469,576 | 5/1949 | Ritter | 132/279 |
| 2,558,305 | 6/1951 | Marvin | 132/261 |
| 2,611,377 | 9/1952 | Barnes | 132/40 |
| 2,818,871 | 1/1958 | Beaudry | 132/278 |
| 2,910,990 | 11/1959 | Cecil | 132/253 |
| 3,001,254 | 9/1961 | Schumm | 132/46 R |
| 3,343,549 | 9/1967 | Weitzner | 132/40 |
| 3,626,955 | 12/1971 | Greenwood | 132/273 |
| 4,272,869 | 6/1981 | Willner | 24/3 R |

*Primary Examiner*—Gene Mancene
*Assistant Examiner*—Adriene J. Lepiane
*Attorney, Agent, or Firm*—Spensley Horn Jubas & Lubitz

[57] ABSTRACT

Hair fasteners which can be coupled together. Each fastener of the illustrated embodiment has a stub and a socket so as to allow the stub of one fastener to be inserted into the socket of another thereby to couple the fasteners.

12 Claims, 1 Drawing Sheet

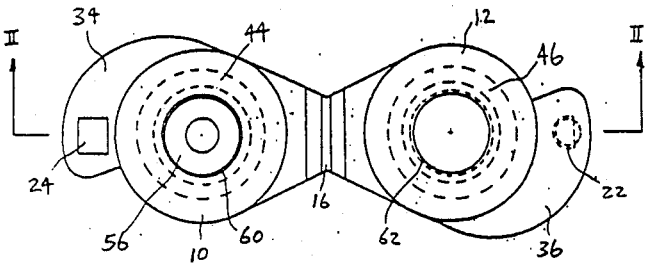
FIG. 1
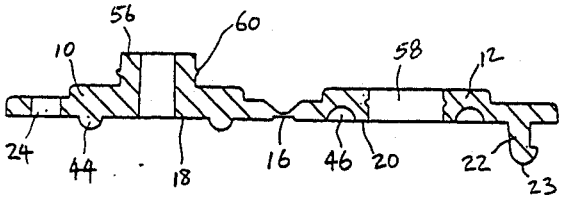
FIG. 2
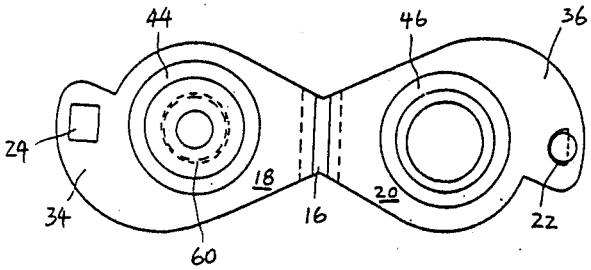
FIG. 3
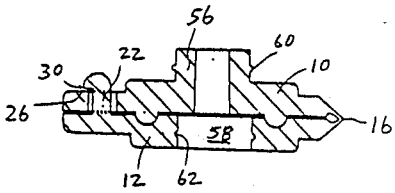
FIG. 4
FIG. 6
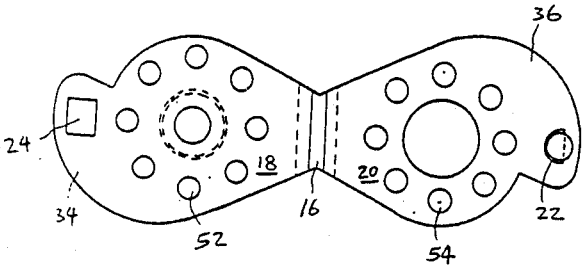
FIG. 5
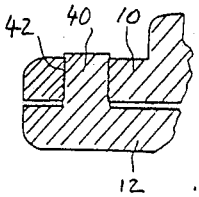

HAIR FASTENER

BACKGROUND OF THE INVENTION

1. Field of the Invention

The present invention relates to hair clips and other fasteners which may be interconnected for grouping clusters of hair to facilitate treatment of hair and styling of hairdos.

2. Description of Related Prior Art

When applying certain hair products such as dye or bleach to a person's hair for hair treatment and styling hairdos, many processes require separating the bulk of the person's hair into clusters and isolating the clusters so as to permit, for example, different shades of dye to be applied to the different clusters of hair in different quantities. It typically takes a professional hair dresser considerable time and patience to neatly separate the hair into clusters in preparation for application of hair products. It is therefore desirable to securely maintain the clusters in place when the hair is subsequently handled by the hair dresser in the hair treatment or styling process.

The quality of many hairdos is improved by dividing the bulk of the hair that is to be treated or styled into a greater number of clusters, each comprising a smaller number of strands of hair. For example, to create the appearance of a progressive change in hair color from a darker shade in one region on a person's head to a lighter shade in another, better results can be obtained by applying dye to a small section of the hair at a time and by progressively increasing the shade of the dye from one section to another. It is therefore desirable to have a quick and easy means of maintaining the hair in numerous clusters in order to facilitate the hair coloring or treatment process.

SUMMARY OF THE INVENTION

The present invention is directed to hair fasteners which can be coupled together for securely grouping clusters of hair stemming from different sections of a person's scalp. In the illustrated embodiment, the hair fastener includes two snap portions connected by a hinge whereby the two snap portions may be folded toward one another about the hinge so as to clamp a bundle of hair. In one aspect of the invention, at least one stub is provided on one of the snap portions and at least one socket on the other snap portion. The stub and socket enable the coupling of a number of the hair fasteners. Specifically, the stub of one hair fastener may be inserted into the socket of another hair fastener to couple adjacent fasteners. This feature enables clusters of hair stemming from different sections of a person's scalp to be grouped so as to allow, for example, the same shade of dye to be applied to the clusters in the same group.

In another embodiment of the present invention, a locking mechanism may be provided to securely fasten the free ends of the two snap portions together thereby to prevent the hair fastener from accidental loosening from the hair. The locking mechanism may be of the type utilizing a spring loaded latch or of the type employing a press-fit latch. The hair snap may be removed from the hair by overcoming the spring action or the press-fit of the locking mechanism. Flanges may be provided at the periphery of the two snap portions to provide leverage for a user to force the two snap portions apart against the locking force of the spring loaded latch or the press-fit latch. The hair fastener may be constructed of a single piece of material.

BRIEF DESCRIPTION OF THE DRAWINGS

FIG. 1 is a plan view of a hair fastener in accordance with a preferred embodiment of the present invention in its open position;

FIG. 2 is a cross-sectional view of the fasterner of FIG. 1 along section II—II;

FIG. 3 is a bottom view of the hair fastener of FIG. 1 showing the grip surfaces;

FIG. 4 is a cross-sectional view of the hair fastener of FIG. 1 in its closed position;

FIG. 5 is a cross-sectional view of a press-fit locking mechanism; and

FIG. 6 is a bottom view showing another embodiment of the grip surfaces of the hair fastener.

DESCRIPTION OF THE PREFERRED EMBODIMENT

The following description is of the best presently contemplated mode of carrying out the invention. This description is made for the purpose of illustrating the general principles of the invention and should not be taken in a limiting sense. The scope of the invention is best determined by reference to the appended claims.

FIGS. 1 to 3 illustrate a preferred embodiment of a hair fastener of the present invention in its open position. The hair fastener will be referred hereinafter as "hair snap" since the preferred embodiment is described with reference to a fastener having a snap type closure. The hair snap comprises two snap portions 10 and 12 joined by a "living" hinge 16. The hair snap shown is made of a single piece of material. However, the snap portions may be separate pieces joined at the hinge. Preferably, the hair snap is made of molded plastic such as polyethylene. The hair snap is therefore simple and inexpensive to manufacture and is light in weight.

As shown in FIG. 2, the hinge 16 has a thinner structure as compared to the adjoining snap portions 10 and 12. The thickness of the hinge 16 is chosen to be such that the hinge 16 is flexible and yet strong enough that it will not break when it is flexed. This thickness will depend on the particular material of which the hair snap is made. The snap portions 10 and 12 have generally flat grip surfaces 18 and 20, respectively.

To clamp a strand of a person's hair, the two snap portions as shown in FIG. 2 are folded about the flexible hinge 16 to a closed position as shown in FIG. 4. In this position, the two grip surfaces 18 and 20 are facing one another so as to clamp the hair stand between the grip surfaces. In order to securely maintain the two snap portions in this closed position, the free ends of the snap portions are fastened together by a locking mechanism. Particularly, as shown in FIG. 2, a hook-shaped latch 22 having a round end 23 is provided at the free end of the snap portion 12 and a slot 24 is provided at the free end of the snap portion 10. The latch 22 is cantilevered from the snap portion 12 and can be bent from its nominal position. When closing the snap, the edge of the slot 24 rides over the rounded end 23 of the latch 22 which acts like a cam, thereby causing the latch 22 to bend against the spring action of the cantilever so as to align the latch 22 with the slot 24. In the fully closed position of the snap as shown in FIG. 4, the latch 22 extends through the slot 24 and hooks onto the top surface 26 of the snap portion 10. In this position, the two snap portions are securely fastened thereby tightly gripping the hair strand disposed between the two portions.

To open the snap from its closed position, some force is required to undo the latch 22. The required force is greater than the typical force arising from the hair dresser's handling of the person's hair. Moreover, the force for undoing the latch is to be applied in a specific direction. In the particular embodiment shown in FIG. 4, the user of the hair snap may push the latch 22 toward the hinge of the hair snap to allow the snap portion 10 to be hinged opened with respect to the snap portion 12.

The tip 30 of the latch 22 may be slightly rounded to form a cam surface such that when force is applied to separate the two portions, the tip 30 rides over the slot edge such that the latch 22 is bent to allow the latch 22 to be pulled through the slot. In this case, the parting forces are applied in both directions perpendicular to the two snap portions. To facilitate the application of such forces, flanges 34 and 36 may be provided at the periphery of each snap portion as shown in FIGS. 1 and 3. These flanges are asymmetric with respect to the hinge 16 so that in the closed position the flanges are not facing each other. This will provide room to allow a user to push against the flanges with his or her fingers to separate the two snap portions.

Alternatively, the locking mechanism may be of the type in which a latch 40 provided on one of the snap portion is press-fitted into a slot 42 provided on the other snap portion as shown in FIG. 5. The outer dimension of the latch 40 is made slightly larger than the inner dimension of slot 42 to provide a press-fit connection of the latch 40 and the slot 42.

To ensure that the hair is gripped tightly between the grip surfaces 18 and 20 of the snap portions, an annular ridge 44 is provided on the grip surface 18 of the snap portion 10 and a mating annular groove 46 is provided on the snap portion 12. As shown in FIG. 2, the cross sections of the ridge 44 and the groove 46 are semicircular. In the closed position of the snap, the annular ridge 44 fits snugly inside annular groove 46 as shown in FIG. 4. Thus, the strands of hair held between the grip surfaces 18 and 20 of the two snap portions are pressed tightly between the ridge 44 and the groove 46 even if the spacing between the flat grip surfaces is greater than the thickness of the hair held between the surfaces.

Alternatively, the groove 46 may be eliminated from the second snap portion. When the snap is closed, the top of the ridge 44 will press against the flat grip surface 20 of the snap portion 12 thereby tightly gripping strands of hair between the two grip surfaces 18 and 20. For some applications, both grip surfaces may be entirely flat.

An alternate embodiment of the grip surfaces is shown in FIG. 6. Instead of an annular ridge, a number of studs or bosses 52 may be provided on the grip surfaces 18 of the snap portion 10. The bosses 52 are semispherical and are arranged in a circle. The grip surface 20 of the snap portion 12 may be smooth or alternatively, matching recesses 54 may be provided to fit the bosses 52 when the snap is closed.

It has been found that for certain applications, it is desirable to couple a number of hair snaps together. This allows grouping clusters of hair from different regions of a person's scalp. This is useful to allow, for example, same shade of dye to be applied to the bundles of hair at the same time. It also permits the hair dresser to keep track of the different bundles that are to be treated in a similar manner. For example, if a person's hair is to be dyed in a manner such that the color of the hair is to change from a darker shade at the top of the head to a lighter shade at the lower portion of the head, the result would be improved if the same shade of dye is applied to the group of hair stemming from the same latitude of the head. By coupling the hair snaps which are holding hair from the same latitude, the particular shade of dye can be applied precisely to the correct group of hair.

To accomplish the above, a stub 56 is provided on the snap portion 10 and a socket 58 is provided in the snap portion 12. The socket 58 has an internal shape that will receive a stub 56 of another hair snap of the same design. To connect a number of hair snaps, the stub 56 of one hair snap is inserted into a socket 58 of an adjacent hair snap. In the particular embodiment shown in the figures, the stub 56 and the internal shape of the socket 58 is generally cylindrical. The diameter of the socket is slightly less than the diameter of the stub 56 so as to allow the stub 56 to be press fitted into the socket 58. Adjacent hair snaps may be pulled apart from one another by overcoming the force of the press fit.

To further secure the coupling between two hair snaps, the stub 56 is provided with an annular rib 60 and the socket 58 is provided with an annular groove 62 as shown in FIG. 4. When the stub 56 of a snap is inserted into the socket 58 of another, the rib 60 fits in the groove 62 thereby securing the coupling between the hair snaps. Many such hair snaps may be coupled together in this manner.

What has been described above is a novel hair fastener for tightly clamping a bundle of hair and which can be coupled to another hair fastener of similar design. The structure of the hair fastener is simple, and is therefore inexpensive to manufacture. The hair fastener is light and is easy to use.

It should be noted that the invention is not limited to the embodiments described above. The hair fastener may take on other shapes and the grip surfaces of the snap portions 10 and 12 may be convex and concave, respectively. Several stubs and matching sockets may be provided on each hair fastener such that a number of hair fasteners may be interconnected. The stub and socket may be configured to allow adjacent fasteners to be coupled at an angle. Ornamental features may be added to the basic structure of the hair fastener to form a decorative barrette.

While the invention has been described with respect to the preferred embodiments in accordance therewith, it will be apparent to those skilled in the art that various modifications and improvements may be made without departing from the scope and spirit of the invention. Accordingly, it is to be understood that the invention is not to be limited by the specific illustrated embodiments, but only by the scope of the appended claims.

I claim:

1. A hair fastener for holding strands of hair, comprising:

a first snap portion having an inner grip surface and an outer surface;

a second snap portion having an inner grip surface and an outer surface;

means for securing the two portions together in a closed position in which the inner surfaces of the portions face and abut one another to thereby secure strands of hair between the inner surfaces of the portions; and means integrally carried on the outer surface of the fastener for releasably coupling the fastener in a closed position directly to another similar fastener.

2. A hair fastener as claimed in claim 1 wherein the first and second snap portions are made of molded plastic in one piece.

3. A hair fastener as claimed in claim 2 further including a hinge connection the first and second snap portions wherein the hinge has a region of reduced thickness as compared to adjoining regions thereby to allow flexure of the hinge at the reduced thickness region.

4. A hair fastener as claimed in claim 1 further comprising flanges disposed at the periphery of the first and second snap portions so as to allow a user to apply parting force at the flanges to force the two snap portions apart from a closed position to an open position.

5. A hair fastener as claimed in claim 1 wherein one of the snap portions is generally in the shape of a disc and includes a ridge protruding outward from its grip surface.

6. A hair fastener as claimed in claim 5 wherein the other snap portion is in the shape of a disc and includes a recess in its grip surface for receiving the ridge on the grip surface of the other snap portion in the closed position.

7. A hair fastener as claimed in claim 6 wherein the ridge and the recess are annular.

8. A hair fastener as claimed in claim 6 wherein the ridge is in the form of a plurality of studs arranged in a predetermined configuration on the grip surface and the recess is in the form of matching depressions in the grip surface of the other snap portion.

9. A hair fastener as claimed in claim 1 wherein the securing means includes a hook-shaped latch disposed on one of the snap portions and a slot disposed on the other snap portion for catching the latch to secure the two snap portions in a closed position.

10. A system of hair fasteners for holding strands of hair stemming from different regions of a person's scalp comprising:

a plurality of hair fasteners each comprising:

a first snap portion having a grip surface and a second surface;

a second snap portion having a grip surface and a second surface; means integrally carried on the second surfaces of the snap portions for releasably coupling one fastener in a closed position directly to another fastener;

a hinge connecting the first and second snap portions, wherein the grip surfaces of the first and second snap portions are contiguous by way of the hinge, and wherein the snap portions can be pivoted from an open position where the grip surfaces of the first and second snap portions are apart to a closed position where the grip surfaces are facing one another; and wherein the first and second snap portions and the hinge are made of a single piece of material.

11. A system of hair fasteners as claimed in claim 10 wherein the means for coupling one fastener to another fastener includes at least one stub extending from the second surface of one of the snap portions and at least one socket carried on the second surface of the other snap portion for receiving a stub, wherein the stub of one hair fastener may be inserted into the socket of another to couple the hair fasteners.

12. A system of hair fasteners as claimed in claim 11 wherein the stub is generally cylindrical and includes a rib projecting from the stub and wherein the socket is generally cylindrical and includes a recess for receiving the rib so as to facilitate securing a stub of one snap portion in a socket of another.

* * * * *